United States Patent [19]

Miroshnichenko et al.

[11] 3,991,442

[45] Nov. 16, 1976

[54] ROLLER GIN

[76] Inventors: Georgy Ivanovich Miroshnichenko, ulitsa Glinki, 6, kv. 11; Rostislav Vasilievich Korabelnikov, Chilanzar, kvartal 20, dom 18, kv. 106; Danir Yakubov, ulitsa Chizelnaya, 72; Pavel Nikolaevich Tjutin, ulitsa Akademicheskaya, 9, kv. 25, all of Tashkent, U.S.S.R.

[22] Filed: Mar. 3, 1975

[21] Appl. No.: 554,545

[52] U.S. Cl. ..... 19/53

[51] Int. Cl.[2] ..... D01B 1/06

[58] Field of Search ..... 19/49–53

[56] References Cited

UNITED STATES PATENTS

| | | | |
|---|---|---|---|
| 1,418,106 | 5/1922 | Tischer | 19/53 |
| 3,245,123 | 4/1966 | Brooks | 19/53 |
| 3,251,094 | 5/1966 | Vandergriff | 19/53 |

*Primary Examiner*—Dorsey Newton

*Attorney, Agent, or Firm*—Haseltine, Lake & Waters

[57] ABSTRACT

A roller gin is most effectively used for processing fine-stapled cottons.

The roller gin comprises a ginning roller, a sectional knife urged against the surface thereof and actuated by a vibrator so that the sections of the knife are oscillating in anti-phase, and a stripping organ also made sectional and provided with vanes, the vanes of the changeable sections being turned through an angle sufficient for each vane to cooperate with an appropriate section of the knife and the stripping organ being rigidly coupled to the vibrator through a gearing ratio multiple of the number of the vanes in each section.

Such a roller gin increases the efficiency of ginning, enhances the quality thereof and makes it possible to handle any class of cotton irrespective of the degree of attachment of the fibers to the seeds.

7 Claims, 11 Drawing Figures

ROLLER GIN

The invention relates to machinery intended for processing seed cotton, and, more particularly, it relates to roller gins.

The roller gin is a machine used for separating the fibres from the cotton seeds.

The present invention may be most effectively realized when handling both the fine-stapled cottons, about 45 mm long, and the medium-stapled cottons.

The gins currently used are subdivided into the saw gins and the roller gins. Since the saw gins cause injury to the fibres as well as to the seeds, the use thereof is confined to ginning the medium-stapled cottons only.

For ginning the fine-stapled cottons the roller gins are resorted to.

The roller gin comprises a hopper, a ginning roller, a stationary knife, the blade thereof being urged against the surface of the ginning roller, and a stripping organ extending lengthwisde the knife edge.

The prior art roller gins are rather inefficient and undependable in operation. The stationary knife being constantly urged against the ginning roller, the friction field within the ginning zone remains invariable during operation of the gin.

Due to the friction field the fibres are dragged past the stationary knife by the surface of the ginning roller. The dragging capability of the friction field is determined by the dragging force P to be defined from the equation:

$$P = bh\left[q_o + \frac{K_1 \cdot K_2}{K_1 + K_2}(1 - \Delta\epsilon)\delta_o\right](\mu_1 - \mu_2)$$

where:

$b$ is the width of the ginning roller-to-knife contact area;

$h$ is the width of the lock dragged;

$K_1$ and $K_2$ are the rigidity of the ginning roller surface and the structural rigidity of the knife; $q_o$ is the knife-to-ginning roller constant pressure; $\delta$ is the thickness of the lock dragged; $\Delta\epsilon$ is the additional deformation of the lock at the actual pressure between the knife and the ginnigg roller;

$\mu_1$ is the coefficient of friction of the dragged fibres against the ginning roller;

$\mu_2$ is the coefficient of friction of the cotton fibres against the stationary knife.

The constancy of the knife pressure ($q_o$) restricted by the ginning roller material heat resistance and the friction properties of the interacting bodies ($\mu_1 - \mu_2$) reduce dependability of the process due to slipping of the ginning roller surface over the dragged fibres since during ginning very often P is less than F($P < F$), where F is the force holding the fibres at the edge of the knife.

This condition obtains due to attachment of the fibres to the seeds, the friction force and the curliness of a cottony-down. The cottony-down should be understood as a single seed covered with cotton fibres.

The slipping of the ginning roller surface over the fibres lowers the ginning efficiency and causes injury to the fibres. Temporary increase in the dragging force P sufficient for loosening the fibres from the seeds under the adverse conditions described above may be attained by virtue of development of variable friction properties through changing the $q_o$ according to, say, the sine law: $q_o = q_1 \sin wt$.

The oscillatory motion imparted to the knife entails the varibility of the $q_o$, as a result of which the dependability of the ginning process and, consequently, the capacity of the machine increase.

At present, there is known roller gin comprising a horizontally extending ginning roller, a knife urged against the surface thereof, coupled directly to and obtaining an oscillatory motion from a vibrator, the motion being executed in a radial direction with respect to the ginning roller, due to which the fibres are drawn in between the knife blade and the rotating ginning roller, and a stripping organ provided with vanes and installed rotatably lengthwise the knife blade so that the vanes snatch the seeds from the drawn-in fibres (cf. Inventor's Certificate of the USSR No. 223990; Cl. D01*b*, 1/06).

The disadvantage of the known roller gin consists in that the vibrator actuates the knife so that no coordination with the operation of the stripping organ is provided, i.e. the oscillation period of the knife does not coincide with the period when succeeding vaneof the stripping organ approaches the knife edge for detaching the seeds which deteriorates the ginning conditions and the quality of both the fibres and the seeds.

Apart from this, vibration of the knife, unless such efficient measures as proper adjustment of the exposure gap between the knife and the surface of the ginning rolles at the moments of the knife full deflection with respect to the knife oscillation double amplitude are taken, is of no appreciable effect insofar as the enhancing of the efficiency and dependability of the ginning process is concerned.

Besides, on the roller gins now commonly in use the great efforts should be applied to theknife in its entirety to render the latter oscillatory which causes considerable inertial loads and gives rise to a necessity for increasing the rigidness of the gin construction.

Moreover, due to the above disadvantage it is impossible to manufacture the gins equipped with the ginning rollers of a greater working length as compared with those now in use.

The existing roller gins are uncapable of handling the medium-stapled cottons featuring a high degree of attachment of the fibres to the seeds. In these gins the dragging action of the ginning roller surface on the fibres for the latter to be drawn past the knife is insufficient for separating the medium-stapled cotton fibres from the seeds, therefore these cottons are processed on the saw gins.

Development of a roller gin capable of processing the medium-stapled cotton at a high rate of productivity will considerably enhance the quality of the fibre and add to its spinnability.

It is an object of the present invention to obviate the disadvantages.

It is an object of the present invention to provide a roller gin wherein a knife and a stripping organ will be designed so that a greatly enhanced operating efficiency be afforded.

The principal object of the present invention is to provide a roller gin with a knife and a stripping organ of said design which will ensure a high quality of the fibres.

Another object of the present invention is to provide a roller gin capable of handling the cottons possessed of different degrees of the fibre-to-seed attachment.

One more object of the present invention is to provide a roller gin simple in construction and in manufacture.

This and other objects are attained in a roller gin comprising a horizontally extending ginning roller, a knife urged against the surface thereof and oscillating radially with respect thereto, obtaining a motion from a vibrator due to which motion the fibres are dragged in between the knife blade and the ginning roller, with the latter rotating, and a stripping organ provided with vanes and installed rotatably lengthwise the kinfe blade whereby to separate the seeds from the drawn-in fibres, in which roller gin, in accordance with the present invention, the knife and the stripping organ extending the entire length of the ginning roller are composed of individual sections, the knife sections being coupled to said vibrator so that each section oscillates with a phase shift and an exposure gap is preserved between each said section of the knife and the surface of the ginning roller at the moment of full deflection of the knife amounting to 30 per cent of a double oscillation amplitude of said knife, the vanes of adjacent sections of the stripping member being turned through an angle allowing each vane to cooperate with an appropriate knife section and said stripping organ being rigidly coupled to the vibrator through a gearing ratio multiple of a number of vanes in each section whereby to coordinate the motion of the stripping organ and the knife.

High capacity of the machine is attained through reduction of the slipping of the ginning roller surface over the dragger fibres by means of creating an intensive variable friction field between the knife and the surface of the ginning roller which gives rise to a considerable fibre dragging and seed separation force.

Good quality of the fibres and the seeds is provided due to preserving a constant exposure gap between te vanes of the stripping organ and the blade of the knife in the course of ginning by virtue of coordinating the motion of the stripping organ with that of the knife and also by virtue of minimizing the injury caused by the surface of the ginning roller to the fibres at an appreciably reduced slippage thereof. A possibility of processing any cotton irrespective of the degree of attachment of the fibres to the seeds is afforded also due to establishing an intensive variable friction field between the knife and the surface of the ginning roller possessed of a considerable dragging force sufficient for the fibres to be snatched from the seeds.

Also in accordance with the present invention, the sections of the knife are installed on separate brackets, with the latter mounted on a common stationary axle and driven into an oscillatory motion by a vibrator, the phase shift between the oscillations the knife sections being 180°.

The phase shift of 180° between the oscillations of the adjacent knife sections makes it possible to decrease the inertial loads in the gin as well as to decrease the leads on the ginning roller and its supports.

For securing both the noise-free operation of the machine and durability of the ginning roller the vibrator is provided with eccentries rigidly fitted on the shaft and turned with respect to one another through an angle corresponding to a phase shift established between the oscillations of the adjacent knife sections, the slide blocks with the bearing surfaces adapted to cooperate with the brackets of the knife sections via elastic members being placed on the eccentrics through the medium of roller bearings.

In addition, a rigid coupling between the stripping organ and the vibrator in the herein disclosed roller gin is accomplished by a chain drive. Due to such an execution of the coupling a simplicity of construction, a dependability of operation and a convenience of maintenance are afforded.

To produce te fibres and the seeds of the enhanced quality it is expedient to make the stripping organ vanes split and to secure them on an elastic shell, the purpose in hand being attainable due to elasticity of the vane members.

Also in accordance with the present invention, the knife sections are butt-jointed and the protective angle-pieces are placed above the joints to keep the lint from creeping thereinto.

To facilitate the manufacture and installation of the vibrator it is expedient to make the shaft carrying the eccentrics sectional, to mount each section on supports and interconnect all the sections by means of couplings.

Given below is a detailed description of the present invention with reference to the accompanying drawings wherein.

Figure 1:
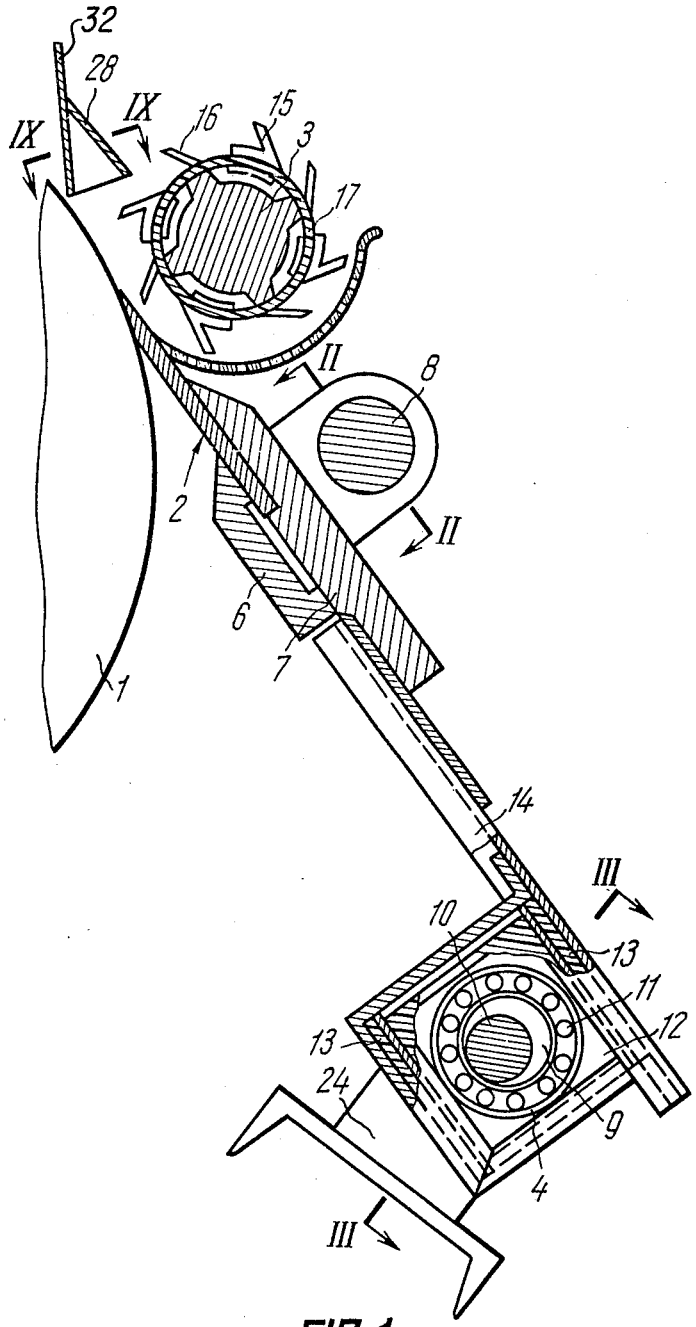
FIG. 1 is a general sectional view of a proposed roller gin.

Referring now to the drawings the roller gin comprises a ginning roller 1 (FIG. 1), a sectional knife 2, a stripping organ 3 and a vibrator 4.

The ginning roller 1 is a cylinder covered with an elastic material and actuated from an electric motor (not shown).

Figure 2:
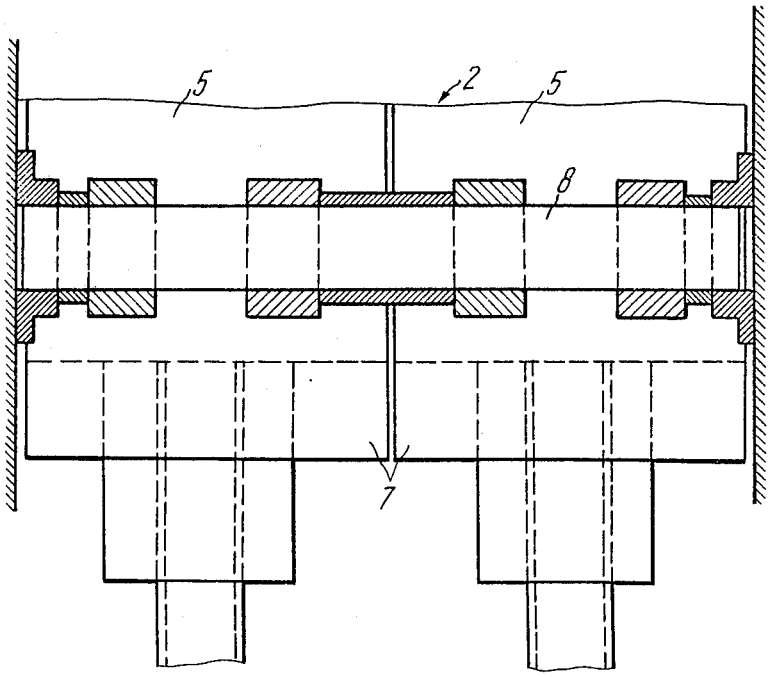
FIG. 2 is a section along II—II of FIG. 1.

The knife 2 is made sectional through the entire length of the ginning roller. Sections 5 (FIG. 2) of the knife 2 are secured through the medium of beams 6 on movable brackets 7 provided with a common stationary axle 8.

Figure 3:
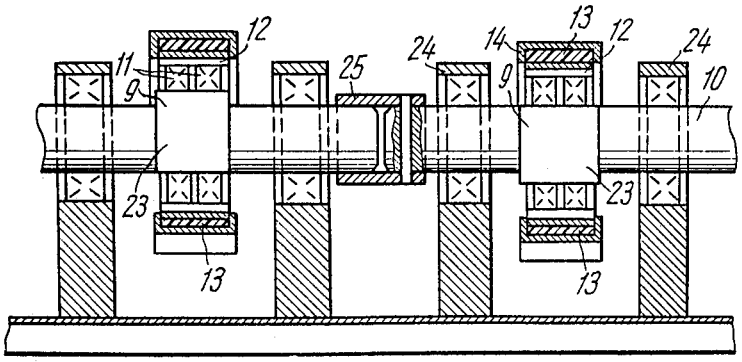
FIG. 3 is a section along III—III of FIG. 1.

The sections 5 of the knife 2 are coupled with the vibrator 4 so that each section oscillates with a phase shift of 180°. This is attained due to the vibrator 4 provided with eccentrics 9 (FIG. 1) rigidly secured on a shaft 10 and turned relative to one another through an angle corresponding to a phase shift of oscillations of the adjacent sections 5 of the knife 2 (as is shown in FIG. 3).

At regular intervals the sections 5 of the knife 2 are urged by the vibrator 4 against the surface of the ginning roller 1 whereby the fibres are dragged in between the knife blade and the ginning roller surface.

Figure 4:
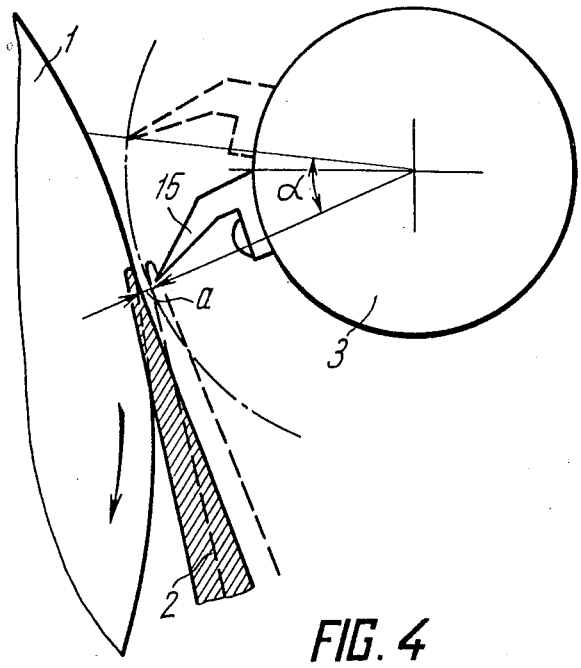
FIG. 4 is a schematic representation of interaction of a knife and a stripping organ.
Figure 5:
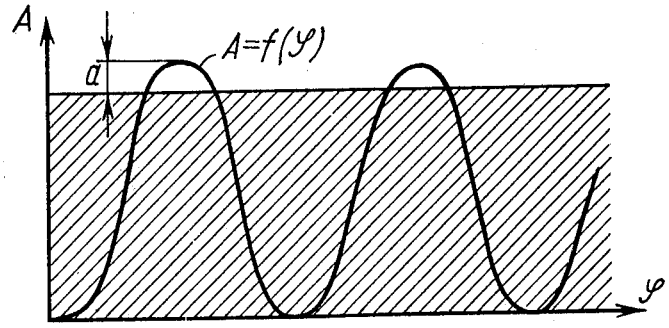
FIG. 5 is a graph of oscillations of a knife versus a vibrator angle of turn.

To make the processing of cottons featuring different degrees of fibre-to-seed attachment possible, between each section and the ginning roller surface at the moments of full deflection of the knife there is provided an exposure gap a (FIG. 4) within 0 to 30 per cent of a double oscillation amplitude A (FIG. 5). Shown conventionally in FIG. 5 is a graph of oscillations of the knife versus a turn angle "$\phi$" of the vibrator 4 for the knife 2.

Figure 6:
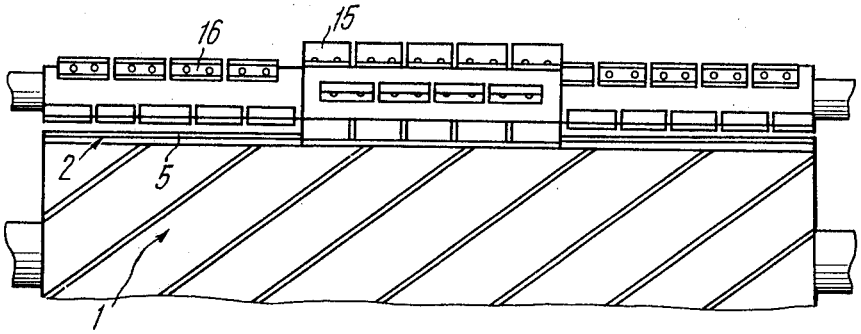
FIGS. 6 and 7 show sections of a stripping organ.
Figure 7:
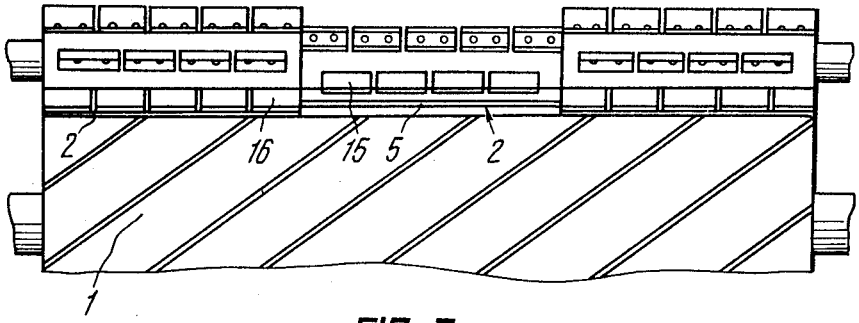
Figure 8:
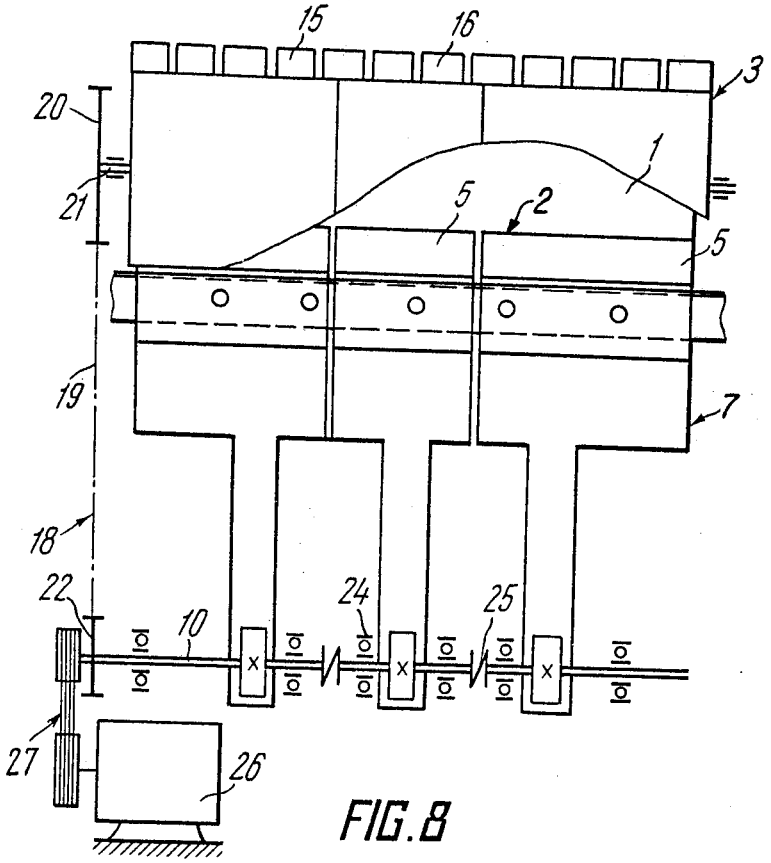
FIG. 8 is a diagrammatic view of a vibrator and stripping organ drive.

The stripping organ 3 (FIG. 1) is also made sectional along the length of the ginning roller. Vanes 15 and 16 (FIGS. 6 and 7) of the adjacent sections are turned through a definite angle whereby the stroke of the vanes is coordinated with the motion of the appropriate sections 5 of the knife oscillating in anti-phase. The vanes 15 and 16 are split at definite intervals along the axis of the stripping organ and secured on an elastic shell 17 (FIG.1). The stripping organ 3 is coupled with the vibrator 4 via a rigid drive 18 (FIG. 8).

Used as the rigid drive is a chain 19 looped over a sprocket 20 seated on a shaft 21 of the stripping organ 3 and over a sprocket 22 placed on the vibrator shaft 10.

The shaft 10 is made sectional, each section 23 thereof (FIG. 3) is mounted on two supports 24, said sections being jointed by couplings 25.

The shaft 10 (FIG.8) is rotated from an electric motor 26 through a V-belt transmission 27. The sections 5 of the knife 2 are mounted butt to butt and protective deflecting angle-pieces 28 (FIGS. 1 and 9) are disposed opposite the joints on the jacket 32 to prevent the fibres from clogging the joints.

The herein disclosed machine operates as follows.

Prior to starting the gin, the ginning roller 1 is adjusted to bear properly against the sections 5 of the knife 2 so that the exposure gap *a* between the surface of the ginning roller 1 and the sections 5 at the full deflection of each section oscillating with a phase shift iswithin 0 to 30 per cent of a double oscillation amplitude depending on a class of cotton treated.

The stripping organ 3 is secured in a position providing a gap of 1.0 to 1.5 mm between the vane 15 and the appropriate section 5 of the knife 2 the vane cooperates with.

The ginning roller 1 and the electric motor 26 started, the vibrator 4 and the stripping organ 3 are actuated through the V-belt drive 27 and the rigid drive 18, respectively. Via the members 9, 10, 11, 12, 13 and 14 the vibrator drives into motion the brackets 7 the sections 5 of the knife 2 are secured on.

As soon as the cotton fibres fall within the ginning zone, they are drawn by the surface of the ginning roller 1 past the knife section 5 urged against the surface thereof.

The oscillations of the knife 2 create a variable friction field between the surface of the ginning roller 1, the fibres and the corresponding section 5 of the knife 2.

This friction field, while varying, may reach a considerable magnitude sufficient for developing a force due to which the fibres are drawn past the knife 2 and detached from the seeds. The variable friction field rules out the slipping of the surface of the ginning roller 1 over the drawn-in fibres which results in a superior product produced at a more rapid rate.

At the moments close to that of the most intimate contact between the surface of the ginning roller 1 and the section 5 of the knife 2 the vane 15 or 16 of the stripping organ 3 approaches the edge of the knife thereby wrenching the seeds from the fibres drawn past the knife 2.

The eccentrics 9 are secured on the shaft 10 so that a phase shift of the oscillations equal to 180° is provided for the section 5 of the knife 2 which is required for reducing both the overall load imposed on the ginning roller 1 and the inertial loads existing therein.

Figure 9:
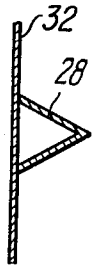
FIG. 9 is a section along IX—IX of FIG. 1.
Figure 10:
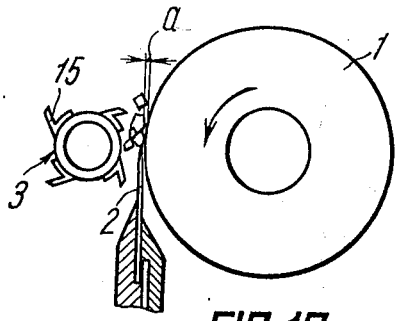
FIGS. 10 and 11 are schematic representations of interaction of a stripping organ with a knife and ginning roller.
Figure 11:
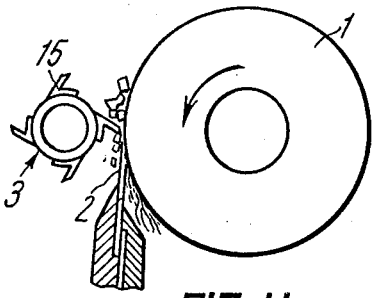

The motion of the stripping organ 3 coordinated with the process of dragging the fibres by the surface of the ginning roller past the section 5 of the knife 2 is schematically represented in FIGS. 10 and 11 as shown in FIG. 9.

At a full deflection of the knife the vanes 15 of the stripping organ are far removed from the edge of the knife 2 (FIG. 10). As soon as the surface of the ginning roller 1 comes in contact with the knife 2 (FIG. 11), the vane 15 turns and approaches the edge thereof at the moment close to that of the most intimate contact between the knife 2 and the ginning roller 1. Such a motion of the vane favours the separation of the seeds from the drawn-in fibres and enhances both the operating efficiency of the gin and the quality of the product obtained.

What is claimed is:

1. A roller gin comprising: a rotatable ginning roller extending horizontally; a knife urged against the surface of said ginning roller and comprised of individual sections; a vibrator imparting to said knife an oscillatory motion in a radial path with respect to the direction of said ginning roller, whereby fibers are dragged in between the knife and the ginning roller when said ginning roller rotates, said vibrator at regular intervals urging each of the sections of said knife against the surface of said ginning rollers and deflecting each of the sections of said knife from the surface of the ginning roller so that at the moment of full deflection between each section of the knife and the surface of the ginning roller there is an exposure gap equal to 30 per cent of the double amplitude of the oscillations of said knife, said knife being coupled with said vibrator so that the section oscillate with a phase shift; a rotatable stripping organ with vanes installed lengthwise the blade of said knife and comprised of individual sections for detaching seeds from the drawn-in fibres by said vanes, said vanes of the adjacent sections of said stripping organ being turned through an angle sufficient for ensuring cooperation of each of said vanes with the respective section of said knife, a rigid drive coupling said stripping organ with said vibrator, said rigid drive having a gearing ratio multiple of the number of said vanes in each section of said stripping organ for coordinating the motions of the stripping organ and the knife.

2. A roller gin as claimed in claim 1 including a separate bracket for supporting each of said sections of the knife, a common stationary axle for mounting all said brackets and obtaining the oscillatory motion from said vibrator, said phase shift of the oscillations of the knife sections being 180°.

3. A roller gin as claimed in claim 1 wherein said vibrator includes a shaft; eccentrics rigidly secured on said shaft and turned with respect to one another through an angle corresponding to the phase shift of the oscillations of the adjacent sections of the knife; roller bearings mounted on said eccentrics; slide blocks fitted via said roller bearings onto said eccentrics and having bearing surfaces, and elastic members, said bearing surfaces cooperating via elastic members with said brackets of the knife sections.

4. A roller gin as claimed in claim 1 wherein said rigid coupling comprises a chain drive.

5. A roller gin as claimed in claim 1 including an elastic shell for mounting said vanes, said vanes of the stripping organ being split and fixed to said elastic shell.

6. A roller gin as claimed in claim 2 wherein said sections of the knife are butt-jointed, and protective angle-pieces placed above the joints.

7. A roller gin as claimed in claim 3 wherein said eccentric shaft comprises individual sections, support means for supporting each section, and couplings for joining all sections.

* * * * *